United States Patent [19]

Tanaka et al.

[11] 4,096,369

[45] Jun. 20, 1978

[54] MICROWAVE OVEN

[75] Inventors: Junzo Tanaka, Fujiidera; Chikao Urashima, Nara; Toshio Kai, Yamatokoriyama, all of Japan

[73] Assignee: Matsushita Electric Industrial Co., Ltd., Osaka, Japan

[21] Appl. No.: 742,122

[22] Filed: Nov. 15, 1976

[30] Foreign Application Priority Data

| | | |
|---|---|---|
| Dec. 2, 1975 | Japan | 50-144467 |
| Dec. 8, 1975 | Japan | 50-146551 |
| Nov. 20, 1975 | Japan | 50-158273[U] |

[51] Int. Cl.[2] ..... H05B 11/00

[52] U.S. Cl. ..... 219/10.55 D; 126/21 A; 219/10.55 B; 219/10.55 R

[58] Field of Search ..... 219/10.55 A, 10.55 B, 219/10.55 F, 10.55 M, 10.55 D; 126/21 A, 21 R

[56] References Cited

U.S. PATENT DOCUMENTS

| | | | |
|---|---|---|---|
| 3,081,392 | 3/1963 | Warner | 219/10.55 B |
| 3,196,243 | 7/1965 | Schall | 219/10.55 D |
| 3,260,832 | 7/1966 | Johnson | 219/10.55 D |
| 3,681,557 | 8/1972 | Suzuki et al. | 219/10.55 D |
| 3,783,219 | 1/1974 | Tateda | 219/10.55 D |
| 3,889,099 | 6/1975 | Nuss | 126/21 A |

*Primary Examiner*—Arthur T. Grimley
*Assistant Examiner*—Bernard Roskoski
*Attorney, Agent, or Firm*—Stevens, Davis, Miller & Mosher

[57] ABSTRACT

A microwave oven providing the combination of dielectric heating by the use of microwaves and resistive heating for scorching the surface of a food. An isolation chamber for accommodating an article to be heated by a resistive heater is formed adjacent to the resistive heater provided in a heating cavity. When heating by the resistive heater is desired, the article to be heated is accommodated in the isolation chamber so that it is heated either both by dielectric heating and resistive heating or solely by resistive heating for scorching in an effective manner and at the same time minimizing the contamination of the heating cavity. In this manner, the application of the microwave oven may be widened and the usefulness of the microwave is enhanced.

6 Claims, 5 Drawing Figures

MICROWAVE OVEN

When a food is cooked by a microwave oven, it is cooked in a natural manner. On the other hand, the cooking by the microwave oven produces no scorching on the surface of the food. This may sometimes be a drawback in that it decreases people's appetite. For example, when a fish or meat is cooked, it is better from the standpoint of a person's appetite to scorch the surface thereof rather than to cook it in a completely natural manner. It has thus been proposed, as disclosed in the U.S. Pat. No. 3,320,396, to provide a resistive heater device in the heating cavity of a microwave oven to allow resistive heating of the food in order to eliminate the inconvenience of the prior art oven. However, since the microwave oven includes a number of electrical parts necessary to effect microwave oscillation, the output power to the heater is naturally limited because excessive power would result in vital damage to those electrical parts. Because one of the best advantages of the microwave oven lies in the ability to cook in a short time, the commercial value of the microwave oven would be substantially reduced if the resistive heater required a long heating time. It is, therefore, an important requirement for the microwave oven with a resistive heater to be able to efficiently heat the food with a low power resistive heater. Other significant advantages of the microwave oven lie in that there is no local excessive heating of the food, that there is little oil and smoke generated from the food, that only the food is heated by dielectric heating but the heating cavity itself is not substantially heated and hence the temperature of the heating cavity does not reach a high temperature with the result that the oven will be rarely contaminated or discolored and it may be kept clean without frequent cleaning. Accordingly, in the microwave oven with the resistive heater, it is also significant in increasing the commercial value to minimize the contamination of the heating cavity and to facilitate the maintenance.

The present invention is intended to overcome the inconveniences of the prior art oven and meet the above requirements.

It is, therefore, a primary object of the present invention to provide a microwave oven with a resistive heater wherein an isolation chamber which prevents the entrance of air flow thereto is formed at a position facing the resistive heater provided in the heating cavity of the microwave oven. This structure permits the food to be heated by the resistive heater within the isolation chamber in such a manner that it is efficiently scorched in a short time by the heat from a resistive heater having a small output power, and at the same time any adverse effect of the heat from the resistive heater upon electrical parts such as a microwave oscillator is minimized and contamination by the oil and smoke generated by the resistive heating of the food can be confined within the isolation chamber thereby minimizing the contamination of the heating cavity and facilitating maintenance.

It is a second object of the present invention to suppress the rise in temperature of the door of the oven during resistive heating to minimize the possibility an operator will receive burns due to careless manipulation during use and at the same time permitting the use of less heat resistive, and hence less expensive material for the door, and to prevent thermal deformation of the door to prevent leakage of the electromagnetic wave.

It is a third object of the present invention to enhance the thermal sealing property of the isolation chamber for improving thermal efficiency during resistive heating and preventing contamination of the heating cavity other than the isolation chamber, preventing decrease of the shielding effect for the electromagnetic wave when the door is closed since such decrease would otherwise occur due to the contamination of the inside surface of the door, and preventing rise of the temperature of the door which would otherwise occur when the heat radiated from the resistive heater directly impinges on the door.

It is a fourth object of the present invention to facilitate the wiping-off of the contamination deposited on a shielding plate by the heat of the resistive heater.

It is a fifth object of the present invention to facilitate the cleaning of the contamination deposited on the shielding plate by the heat of the resistive heater and at the same time to leave a wide space in the heating cavity to be used during microwave heating.

It is a sixth object of the present invention to permit visual observation of the article to be heated through the shielding plate for allowing better heating to the article and to construct the shielding plate such that it does not adversely affect the heat distribution during microwave heating.

It is a seventh object of the present invention to reduce the amount of infrared radiation (heat rays) transmitted through the shielding plate so as to efficiently heater the food by the resistive heater and suppress the rise of temperature of the door by heat from the resistive heater.

It is an eighth object of the present invention to construct the isolation chamber formed in the heating cavity in the simplest way.

It is a ninth object of the present invention to facilitate the cleaning of a tray and to leave a wide space in the heating cavity for use during microwave heating.

It is a tenth object of the present invention to reduce the amount of infrared radiation which leaks from the isolation chamber through the tray for efficiently heating the food by the resistive heater.

The above and other objects, features and advantages of the invention will become more apparent from the following detailed description of the preferred embodiment of the invention when taken in conjunction with the accompanying drawings, in which.

Figure 1:
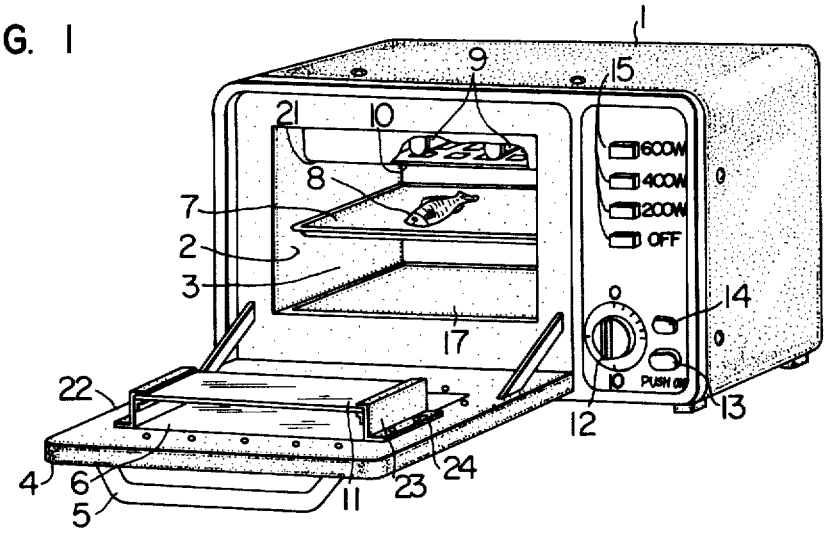
FIG. 1 is a perspective view of a microwave oven with a resistive heater in accordance with one embodiment of the present invention.

A microwave oven heats and cooks an article such as food using a microwave electromagnetic wave at a frequency of 2450 MHz, for example. As shown in FIG. 1, it comprises a heating cavity 3 formed by conductive walls 2, which may be made of stainless steel plates, within a main body 1, and a door 4 mounted to the body 1 to selectively close a front opening of the heating cavity 3. The door 4 has a door handle 5 for facilitating the opening and closing operation of the door 4, a viewing window 6 to allow visual observation of the inside of the heating cavity 3, and a shielding plate 11 for preventing the rise in temperature of the door 4 and the viewing window 6 due to the heat radiation radiated when an article 8 to be cooked supported on a removable tray 7 is heated by a resistive heater 9 mounted at the top of the heating cavity 3, through a grid 10. Numeral 12 denotes a timer which is adapted to be turned to a desired set time position so that power is fed during the set time period and when the set time period has elapsed the timer is reset to the initial position and the power is blocked. Numeral 13 denotes a start button for the microwave heating, 14 denotes an operation indicator lamp which lights during the microwave heating, and 15 denotes a group of switches for the resistive heating. By depressing one of those switches, any one of 200 W, 400 W and 600 W heater powers may be selected, and by depressing an OFF switch the heating is stopped.

Figure 2:
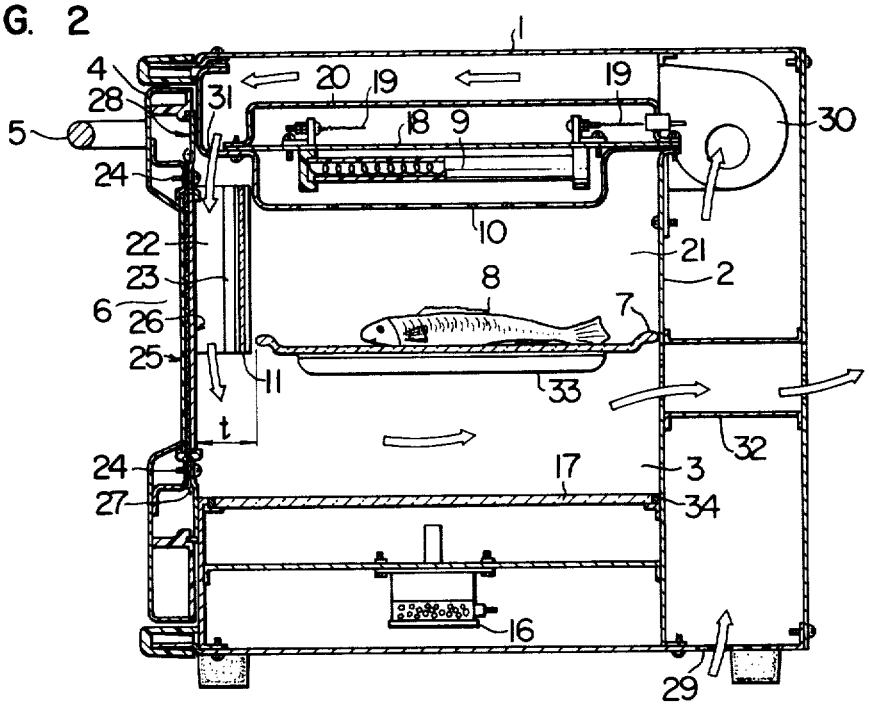
FIG. 2 is a longitudinal sectional view of the microwave oven of FIG. 1.
Figure 3:
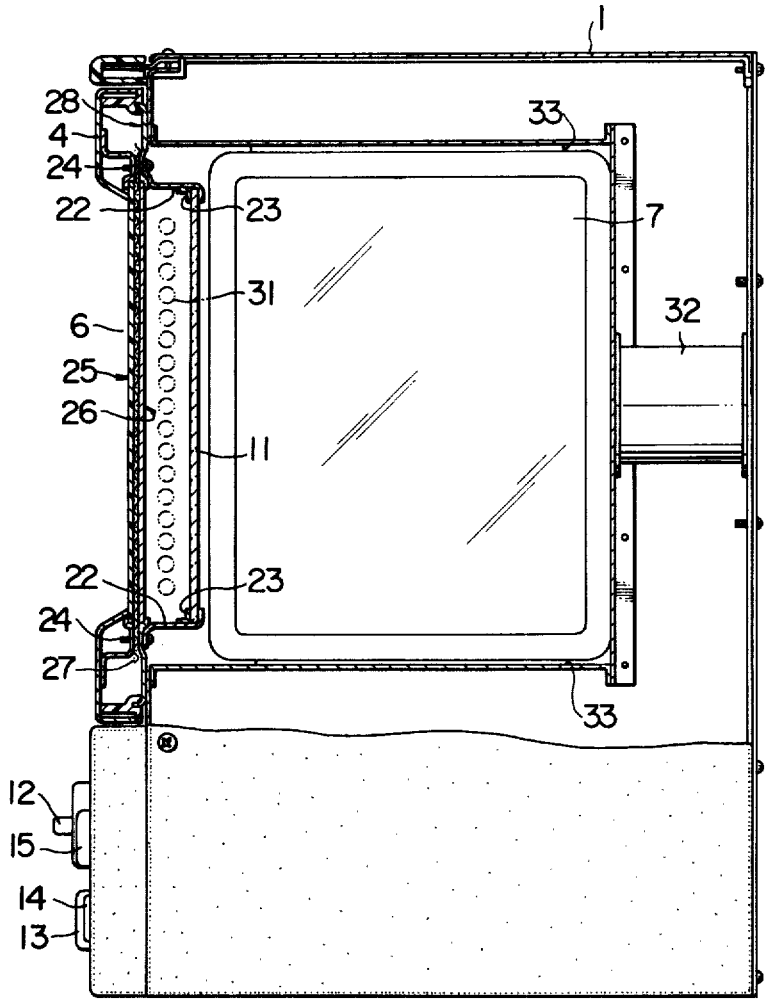
FIG. 3 is a cross sectional view of the microwave oven of FIG. 1.

FIGS. 2 and 3 show the further details of FIG. 1. As shown therein, disposed at the bottom of the heating cavity 3 are a magnetron 16 for radiating microwaves and a partition and tray 17 of electromagnetic wave transmitting and heat resisting material, such as crystal glass, for protecting the magnetron 16. Disposed above the resistive heater 9 is a reflecting plate 18 above which disposed is an electromagnetic wave shielding plate 20 for shielding the electromagnetic wave within the heating cavity 3 which leaks along leads 19 of the heater 9. There is provided a gap *t* between the tray 7 and the door 4, and an isolation chamber 21 which faces the heater 9 for scorch cooking is defined by the heating cavity 3 and the tray 7 with the exception of that area of the heating cavity 3 which is adjacent to the door 4. The shielding plate 11 is supported by support members 22, 23 on the side of the isolation chamber 21 which faces the door 4 and detachably mounted to the door 4 by bolts 24. The viewing window 6 comprises an outer resin plate 25 and an inner strengthened glass plate 26, between which a metal grid 27 for shielding electromagnetic wave is interposed and fixed to the door 4 by bolts 24. Numeral 28 denotes a metal contact plate which is closely contacted to peripheral edges of a front opening of the heating cavity 3.

Referring to FIG. 2, a cooling system is explained. Air attracted by a cooling fan 30 through perforations 29 formed at the bottom of the body passes between the body 1 and the electromagnetic wave shielding plate 20 and is blown out through perforations 31 formed at the front top of the heating cavity. Since the shielding plate 11 serves as the door for the isolation chamber 21 as well as an air guide, a substantial amount of air is passed, through the perforations 31 passes between the door 4 and the shielding plate 11, through a portion of the heating cavity 3 other than the isolation chamber 21, through an exhaust guide 32 and is then exhausted to the exterior. Numeral 33 denotes a support rail for the tray 7, which is fixed to the wall 2 of the heating cavity. Numeral 34 denotes silicone rubber putty to seal the junction of the outer periphery of the partition and tray 17 and the wall 2 of the heating cavity for preventing water or the like from penetrating to the antenna of the magnetron 16.

By constructing the isolation chamber 21 in the manner described above, the article to be cooked is protected from being subjected to a substantial amount of cooling air flow resulting in enhancement of the temperature rise of the article 8 to be heated. At the same time, since the heat radiated from the heater 9 is confined within the isolation chamber 21, efficient heating by the heater is attained with the result that the heating can be effected in a short time with the heater 9 having a relatively small output power. Furthermore, the adverse affect by the heat of the heater 9 on the magnetron 16 can be minimized. In addition, since only the isolation chamber 21 is contaminated and other areas of the heating cavity 3 are not essentially contaminated during resistive heating, maintenance is facilitated. By the provision of the shielding plate which selectively closes the opening of the isolation chamber 21 between the door 4 and the heating cavity 3, the sealing property of the isolation chamber 21 is further enhanced, the efficiency of the resistive heating can be further improved and the contamination of the areas of the heating cavity other than the isolation chamber during the resistive heating is further reduced. Since the door 4 is prevented from being contaminated during resistive heating, the deposition of oil or the like at the junction of the contact plate 28 and the periphery of the opening of the heating cavity is minimized and the sealing property of the heating cavity 3 is improved, preventing the leakage of electromagnetic waves from the periphery of the opening of the door. Further, since there is provided a gap between the shielding plate 11 and the door 4, the heat radiated from the heater 9 is blocked to a great extent by the shielding plate 11 and an air layer is formed between the door 4 and the shielding plate 11 so that the temperature rise of the door 4 and the viewing window 6 is suppressed. As a result, a safe microwave oven is provided which is free from the risk of burns even if an operator carelessly touches the door 4 or the viewing window 6. Furthermore, the viewing window 6 may be made of a less heat resisting and less expensive material. By passing the cooling air flow through the gap between the door 4 and the shielding plate 11, the door 4 and the viewing window 6 can be further cooled. By mounting the shielding plate 11 to the door 4, the contamination of the shielding plate 11 can be readily wiped off after cooking by the resistive heating by opening the door 4. By detachably mounting the shielding plate 11, the cleaning of the shielding plate 11 is further facilitated, and by removing the shielding plate 11 during heating by microwave radiation, a heating cavity having a wider space is assured. When the shielding plate 11 is made of transparent glass having a small dielectric loss and high heat resistance, the degree of scorching of the article 8 can be viewed from the viewing window 6 so that a microwave oven of a high operability is provided and satisfactory heat distribution is attained without disturbing the electric field distribution during microwave heating. This effect is remarkable particularly in a so-called central feeding microwave oven in which the parts in the heating cavity 3 are arranged symmetrically both laterally and longitudinally.

When the shielding plate 11 is made of a so-called heat ray reflecting glass which comprises a transparent glass on which surface iron, antimony or the like is deposited, the light transmission is slightly deteriorated but the amount of infrared radiation transmitting through the shield plate 11 is very much reduced so that the temperature in the isolation chamber 21 is further raised to allow more efficient heating by the resistive heater and at the same time the rise of the temperature of the door 4 and the viewing window 6 can be effectively suppressed.

By defining the isolation chamber 21 by the wall of the heating cavity 2 and the tray 7 for the article 8 to be cooked, the isolation chamber 21 can be formed in the simplest way without waste. By detachably mounting the tray 7, the cleaning thereof after the resistive heating can be facilitated, and during microwave heating the tray may be removed to provide a wider space in the heating cavity 3. The tray 7 may be made of a highly heat resisting glass or ceramic material, and it is preferably of an opaque material rather than a transparent material, because transparent material transmits not only visible light rays but also infrared or heat rays which are close to the visible light rays and hence the temperature of the isolation chamber 21 decreases accordingly. When the opaque material is used efficient heating by the resistive heater (to give a scorching effect) can be attained.

Figure 4:
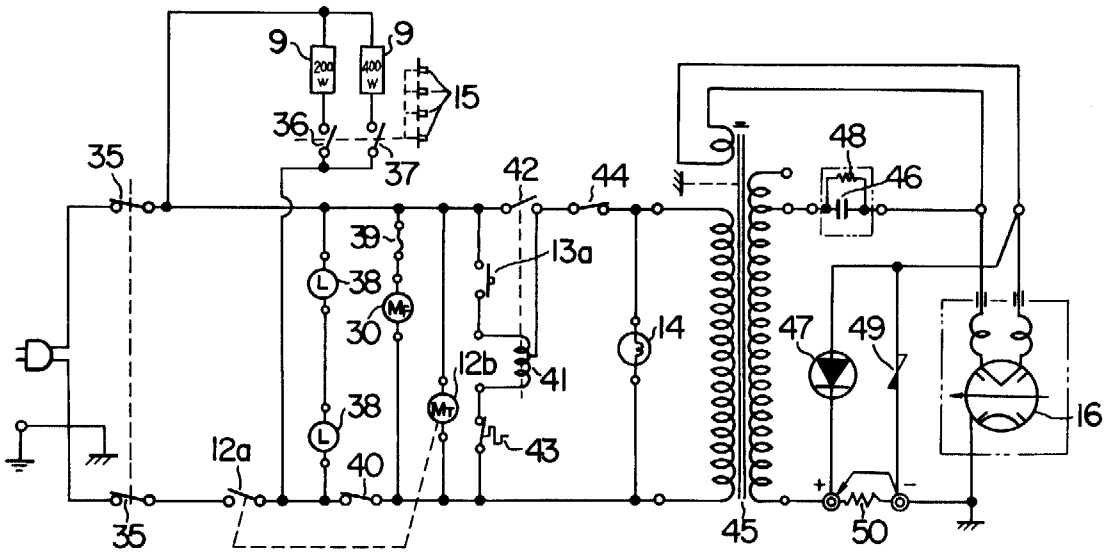
FIG. 4 shows an electrical circuit diagram of the microwave oven of FIG. 1.

FIG. 4 shows an electrical circuit diagram of the microwave oven, in which numeral 35 denotes a normally close safety switch which is opened when the main body 1 is disassembled in order to protect the serviceman. Numeral 12*a* denotes a contact of the timer 12 shown in FIG. 1, 12*b* denotes the motor of the timer 12, and 200 W and 400 W heaters 9 are connected to a power supply through switch contacts 36, 37, the timer contact 12*a* and the safety switch 35. Numeral 38 denotes an over lamp for illuminating the inside of the heating cavity 3. Connected in series with the cooling fan 30 are a fuse 39 which prevents over heating of the heating cavity 3 and a first door switch 40 which is opened when the door is opened. Numeral 13*a* denotes a normally open switch contact which is linked to the start button 13 for microwave heating, 41 denotes a solenoid for actuating a normally open power relay contact 42, 43 denotes a thermal switch for preventing over heating of the magnetron 16, and 44 denotes a second door switch which is opened when the door is opened. The magnetron 16 is energized by a half-wave voltage doubler circuit comprising a high voltage transformer 45, a high voltage capacitor 46 and a diode 47 to oscillate at microwaves. Numeral 48 denotes a discharge resistor for the high voltage capacitor 46, 49 denotes a varistor for absorbing a surge voltage developed across the magnetron 16, and 50 denotes a resistor for checking the anode current of the magnetron 16.

In operation, the article 8 to be cooked is placed in the heating cavity 3, the door 4 is closed and the timer 12 is turned to set a desired time. Then, the timer contact 12*a* is closed, the oven lamp 38 lit, and power supplied to the cooling fan and the timer motor 12*b* through the first door switch 40. When the start button 13 for the microwave heating is then depressed to close the switch 13*a*, the solenoid 41 is energized to close the power relay contact 42, and the operation indicator lamp 14 and the high voltage transformer 45 are energized so that the operation indicator lamp 14 is lit and the microwave oscillation is started for heating the article 8. Once the power relay contact 42 has been closed, it self-holds and hence remains closed even after the switch 13*a* has been opened. When the time period set by the timer 12 has elapsed, the timer motor 12*b* opens the timer contact 12*a* to open the power relay contact 42. As a result, the microwave heating for the article 8 is stopped. The operation of the resistive heater 9 is now explained. The heater 9 is energized through the group of switches 15 as shown in FIG. 1. The relation between the group of switches 15 and the switch contacts 36, 37 are such that when the 200 W switch is depressed, only the switch contact 36 is closed, when the 400 W switch is depressed, only the contact 37 is closed, and when the 600 W switch is depressed, both the contacts 36 and 37 are closed, and when the OFF switch is depressed, both the contacts 36 and 37 are opened. By selecting a desired power by the group of switches 15 and setting a desired time by the timer 12, the resistive heating is effected for the set time period. As seen from the circuit diagram of FIG. 4, the resistive heating and the microwave heating can be effected either separately or simultaneously.

When it is desired to bake a fish, for example with the microwave oven thus constructed, the fish 8 is placed on the tray 7 made of a low dielectric loss material, so shown in FIGS. 1 and 2, and the tray 7 is mounted on the support rail 33 in the heating cavity, and then the door 4 is closed. Thus, the fish 8 is located within the isolation chamber 21 formed by the tray 7, the heating cavity wall and the shielding plate 11. The fish is heated from the bottom by the microwave heating while it is heated from the top by the resistive heater 9 so that it is cooked satisfactorily with scorching being made on the surface thereof. The operation procedure has been explained in connection with the operation of the circuit.

Figure 5:
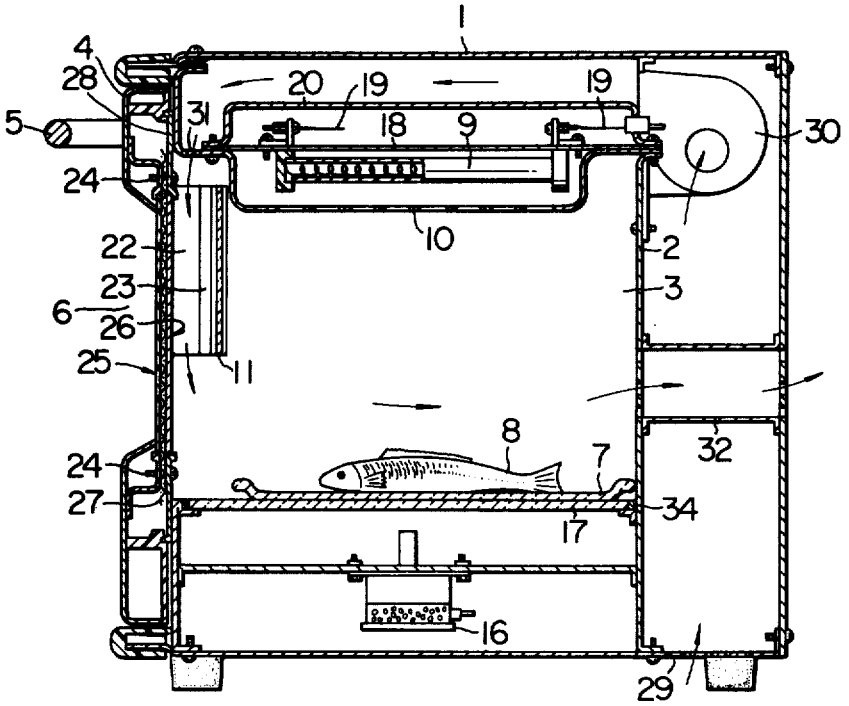
FIG. 5 is a longitudinal sectional view of a microwave oven according to another embodiment of the present invention.

FIG. 5 shows another embodiment of the present invention in which as compared with the embodiment described above the isolation chamber 21 is not formed in the heating cavity 3 but the tray 7 is placed on the partition 17. Since the heat shielding plate 11 is mounted on the door 4 in a similar manner as described in the foregoing, the cooling air flow from the cooling fan 30 is guided through the channel formed between the electric wave shielding plate 20 and top wall of the main body 1 and through the perforation 31 to reach the gap between the heat shielding plate 11 and the door 4. The door 4 including the viewing window 6 is thus prevented from being heated by the radiated heat from the heater 9. The cooling air is then exhausted from the guide 32 through the heating cavity 3.

What is claimed is:

1. A microwave oven comprising
a heating cavity within a main body of said oven,
a door for closing and opening an opening of said heating cavity,
a microwave generator radiating microwave energy into said heating cavity,
a resistive heater within said heating cavity for scorching the surface of an article to be cooked,
a cooling device supplying cooling air to said oven,
an isolation chamber formed by a first portion of said heating cavity separated from a second portion by means of a removable tray for supporting the article to be cooked,
said isolation chamber being adjacent said resistive heater, and
a shielding plate for blocking an opening of said isolation chamber, said shielding plate being mounted on said door with an air gap therebetween so that said air gap communicates with said second portion of said heating cavity to permit the cooling air to flow through said air gap and said second portion of said heating cavity.

2. A microwave oven according to claim 1 wherein said shielding plate is a transparent glass plate detachably mounted on the inside surface of said door by means of support members and bolts.

3. A microwave oven according to claim 2, wherein said transparent glass plate is treated for heat ray reflection to reduce the amount of infrared radiation penetrating said transparent glass plate.

4. A microwave oven according to claim 1, wherein said shielding plate is supported at both left and right sides thereof by support members made of elongated plates and separated from an inner strengthened glass plate of a viewing window, said support members being substantially parallel to said inner strengthened glass plate thereby forming a cooling air channel defined by said inner strengthened glass plate, said elongated support plates and said shielding plate.

5. A microwave oven according to claim 1, wherein said resistive heater is located at the top of said heating cavity and said microwave generator is located at the bottom of said heating cavity, and wherein a cooling air channel is further formed between a top wall of said heating cavity and a top wall of said main body of the oven thereby permitting circulation of a cooling air flow around said isolation chamber through said cooling air channel between said top wall of the heating cavity and said top wall of the main body and through said air gap between said door and said shielding plate and through said second portion of the heating cavity.

6. A microwave oven comprising a heating cavity formed by a separate metallic enclosure within a main body of said oven, a door for freely closing and opening an opening of said heating cavity, said door including a viewing window having a metal grid sandwiched by an outer resin plate and an inner strengthened glass plate, a resistive heater mounted on a top wall of said heating cavity, said top wall consisting of a reflecting plate and being covered by an electromagnetic wave shielding plate for preventing leakage of microwave energy along a lead line of said resistive heater exposed above said reflecting plate, a cooling device having a cooling fan for supplying cooling air to the oven, a tray removably supported by side walls of said heating cavity and dividing said heating cavity into two compartments consisting of an upper and a lower compartment, an isolation chamber formed by the upper compartment of said heating cavity to expose a food stuff on said tray to infrared radiation emitted by said resistive heater, a shielding plate for opening and closing an opening of said isolation chamber and for preventing infrared radiation emitted by said resistive heater from directly impinging on the viewing window of said door, said shielding plate being a transparent glass plate detachably mounted on said door by means of elongated-plate supporting members supporting said shielding plate at both right and left sides thereof in parallel with the plane of said viewing window with a gap formed therebetween forming, a cooling air channel defined by the inner strengthened glass of said viewing window, said shielding plate and said elongated-plate supporting members, cooling air being circulated from said cooling device around said isolation chamber by way of a passage formed between said electromagnetic wave shielding plate and a top wall of said main body of the oven, the cooling air flow channel formed between said shielding plate and said viewing window, and by way of said lower compartment of said heating cavity.

* * * * *